United States Patent [19]

Olson

[11] Patent Number: 4,492,385

[45] Date of Patent: Jan. 8, 1985

[54] SKATE HAVING AN ADJUSTABLE BLADE OR WHEEL ASSEMBLY

[76] Inventor: Scott B. Olson, 8701 Virginia Ave. South, Bloomington, Minn. 55438

[21] Appl. No.: 400,302

[22] Filed: Jul. 21, 1982

[51] Int. Cl.[3] ..... A63C 17/18

[52] U.S. Cl. ..... 280/7.13; 280/11.22

[58] Field of Search ..... 280/11.22, 7.13, 7.14, 280/11.27; 24/68 SK, 71 SK; 292/257

[56] References Cited

U.S. PATENT DOCUMENTS

| | | | |
|---|---|---|---|
| 3,026,118 | 3/1962 | Paré | 280/7.13 |
| 3,281,971 | 11/1966 | Weitzner | 280/7.13 |
| 3,287,023 | 11/1966 | Ware | 280/11.2 |
| 3,292,940 | 12/1966 | Weitzner | 280/7.13 |
| 3,351,353 | 11/1967 | Weitzner | 280/7.13 |
| 4,008,901 | 2/1977 | Conn | 280/7.13 |
| 4,108,450 | 8/1978 | Cote | 280/7.13 |
| 4,114,295 | 9/1978 | Schaefer | 36/100 |
| 4,150,499 | 4/1979 | Wang | 280/7.13 |

*Primary Examiner*—Joseph F. Peters, Jr.
*Assistant Examiner*—Michael Mar
*Attorney, Agent, or Firm*—William L. Huebsch

[57] ABSTRACT

A skate having an interchangeable operative blade or wheel assembly that is releasably fastened to a shoe or boot in a manner affording the selective longitudinal displacement of the blade or wheel assembly with respect to the shoe, and the precise positioning of the blade or wheel assembly with respect to the shoe in order to optimize the performance of the skate for the skater.

6 Claims, 9 Drawing Figures

SKATE HAVING AN ADJUSTABLE BLADE OR WHEEL ASSEMBLY

BACKGROUND OF THE INVENTION

The present invention relates to a skate and more particularly to a convertible skate for which the operative blade or wheel assembly is easily removable and/or interchangeable.

Skates, both ice and roller, have long been popular recreational devices. Such skates generally include an operative portion, i.e. an ice blade or a wheel assembly which enables the skater to glide upon a supporting surface such as ice or sidewalk, and a shoe or boot fitted to the person who is to wear the skates, which mounts the operative portion on each foot of the skater. Typically, the operative portion of the skate, i.e. the ice blade or the wheel assembly, is permanently fastened to the bottom or sole of the shoe or boot. With both ice skates and roller skates the shoe or boot serves the same function, however, the operative portion must be different depending upon whether one is skating on ice or another surface not suitable for ice blades. Therefore, separate skates have generally been required for ice skating and for roller skating.

Convertible skates have, however, been designed which afford the selective attachment of either an ice blade or a wheel assembly to the same boot in order to eliminate the requirement and expense for separate shoe portions for each different operative portion, e.g., separate ice and roller skates. Such a convertible skate is described in U.S. Pat. No. 4,114,295. Although this skate does provide for the interchange between an ice blade and wheels, it does so with a configuration that is dimensionally fixed, i.e., the skate utilizes fixed projections on the operative portion which are spaced a predetermined distance to match spaced and cooperating recesses on the sole of the shoe. These recesses within the sole are located underneath and toe and the heel of the shoe. Thus the positioning of the recesses is fixed, with the distance between the recesses being determined by the shoe size. In addition to attaching the operative portion to the shoe, these cooperating projections and recesses also establish and fix the position of the operative portion with respect to the shoe. This is a problem with U.S. Pat. No. 4,114,295 skate since the positioning of the operative portion with respect to the skater becomes dependent upon the shoe size rather than upon the skating requirements for the skater. If it is desired to change the relative positioning between the operative portion and the skater, the U.S. Pat. No. 4,114,295 skate would seemingly require a different shoe size. For a given skater this fixed configuration skate does not permit any realistic variance in the positioning or configuration of the operative portion with respect to the shoe. It has however been determined that the positioning of the wheels and/or blade with respect to the shoe is extremely critical for the optimum performance of the skate, thus this fixed positioning of U.S. Pat. No. 4,114,295 skate poses a definite impediment.

SUMMARY OF THE PRESENT INVENTION

In view of the aforementioned shortcomings of such conventional skates, the skate of the present invention has been designed with an operative portion that is releasably fastened to the shoe in a manner affording the removal of the operative portion from the shoe, as well as the ability to selectively longitudinally displace and/or adjust the position and configuration of the operative portion with respect to the shoe in order to optimize the performance of the skate. This improvement allows the skater to utilize different lengths of ice blades or different multiples of wheels with the same shoe, and also gives the skater the flexibility of varying the positioning of the blade or wheels with respect to the shoe, to afford the optimization of the skate for speed or stability. This ability to precisely position the operative portion of the skate with respect to the shoe allows, for example, the wheels to be spread out over a distance normally occupied by the ice blade in order to match the response of an ice skate, while allowing the skater to skate on a non-ice surface. This matched response is critical to an ice skater or a hockey player attempting to perfect ice skating ability during off season warm weather or when ice is otherwise unavailable.

This improvement over conventional skates is achieved through the inclusion within the skate of means for releasably fastening the operative portion to the shoe, which means include a frame having means for engaging and disengaging the operative blade or wheel thereon and for affording the selective longitudinal displacement of the operative portion with respect thereto. This frame is connected to the sole of the shoe. Typically, this frame includes a channel which is closed at one end and open at the other to afford the insertion and/or removal of the blade or wheels. A predetermined combination of spacers are inserted within the channel between the wheels, or in front of the ice blade to position the wheels or ice blade at the desired locations with respect to the frame. Means are also included within the skate to secure the wheels or blade at the desired position within the channel, once they have been inserted.

It is therefore possible with the present invention to easily remove and/or interchange the ice blade or wheels, and to position the ice blade or wheels at a location with respect to the frame which is optimal for desired performance for the skates. Furthermore it is also possible to increase or decrease the number of wheels which are utilized with the skate in order to optimize the skate towards speed or stability.

BRIEF DESCRIPTION OF THE DRAWING

The present invention will be further described hereinafter with reference to the accompanying drawing wherein.

DETAILED DESCRIPTION

Figure 1:
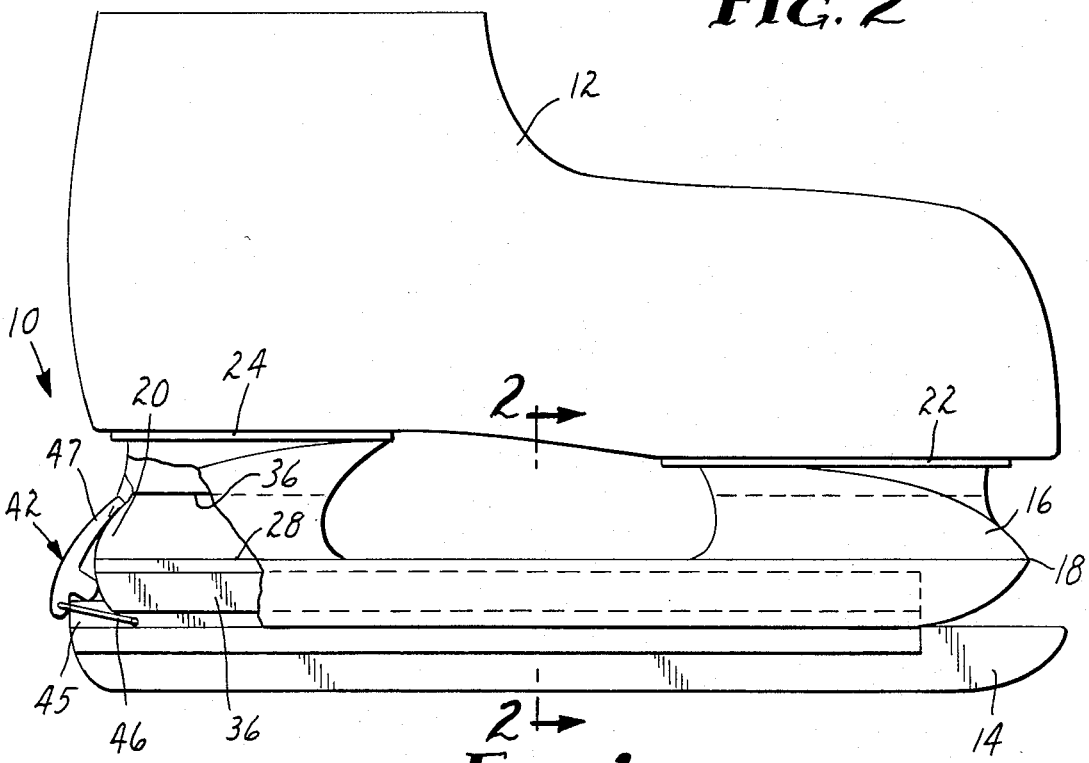
FIG. 1 is a side elevational view of a first embodiment of a skate in accordance with the present invention.
Figure 5:
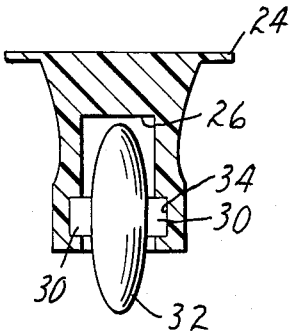
FIG. 5 is a partial sectional view taken along line 5—5 of FIG. 3.
Figure 6:
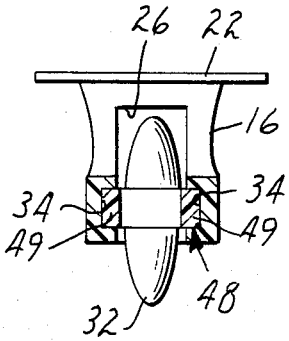
FIG. 6 is a partial sectional view taken along line 6—6 of FIG. 3.

A skate 10 according to the present invention is illustrated in FIG. 1. This skate 10 contains a shoe or boot 12 and an operative portion, as will be described. The operative portion of the present invention can be an ice blade 14 as is illustrated, or a set of rollers 32 (see FIG. 3), which blade 14 or rollers 32 provide means for making contact with a supporting surface such as ice or a roller skating floor only along a single straight narrow area. In order to provide flexibility and cost savings to the consumer, the skate of the present invention is designed to allow the same shoe or boot 12 to be used with any of these alternative configurations for the operative portion. The present invention includes means for releasably fastening the operative portion e.g., the blade 14 or the wheels 32 to the shoe 12. These means include an elongate frame 16 having an anterior end 18 and a posterior end 20 and each end including an appropriate flange or plate 22 and 24 respectively, which can be fastened to the toe and heel of the sole of the shoe 12. Typically, the plates 22 and 24 are riveted to the sole of the shoe, however other means than riveting can be used to fasten the frame 16 to the shoe 12. The skate 10 also contains means for engaging and disengaging the operative portion on the frame 16 and for affording the selective longitudinal displacement of the operative portion with respect to the frame 16. These means include an elongated channel 26 which is adapted to receive an elongate beam 28 of the ice blade 14 as shown in FIG. 1, or an elongate beam 30 on each of the wheels 32 as illustrated in FIG. 5. Although other channel configurations are feasible, the channel 26 of the preferred embodiment has an elongate recess 34 within each of the side walls forming the channel 26. The recesses 34 are adapted to receive corresponding elongate projections 36 on the side walls of the elongate beam 28 of the ice blade 14. In this manner the elongate beam 28 can be engaged within the channel 26. The transverse cross sectional shapes of the side walls defining the channel 26 are elongate in a direction normal to the bottom surface of the sole of the boot 12, and the walls of the frame 16 define a transverse cross sectional shape for the channel 26 that is elongate in a direction normal to the bottom surface of the sole (See FIGS. 2, 4, 5 and 6). In the preferred embodiment the anterior end 18 of the frame is closed to provide a structural member against which the elongate beam of the operative portion 14 can be abutted. Since the frame 16 is typically a molded plastic, the closed end also provides further rigidity. The posterior end 20 is left open to permit the insertion and/or removal of the operative blade or wheels.

The posterior end 20 also contains a manually operable mechanism to secure the elongate beam 28 or 30 of the operative portion within the channel 26 with its single straight narrow contact area centrally aligned with the opening of the channel 26. In the preferred embodiment the securing means comprise an eccentric camming mechanism 42 which engages a projecting ledge 45 on the elongate beam 28 or 30 of the operative portion. The camming mechanism 44 is pivotally mounted on a bracket 46 which in turn is pivotally mounted adjacent the posterior or open end of the frame 16. In this manner the beam 28 or 30 can be inserted within the channel 26 until it contacts the closed anterior end of the channel 26. The camming mechanism can then be pivoted to engage the ledge 45, and finally to secure the beam 28 or 30 within the channel 26. To enhance the mechanical advantage of the camming mechanism 44 and thereby insure a tight fit of the beam 20 or 30 within the channel 26, an elongate handle 47 is included. For aesthetics, this elongate handle is designed to nest within the frame once the beams 28 or 30 are secured within the channel 26. It should be noted that other restraining mechanisms such as a spring loaded detent pin within the frame 16 and a corresponding hole to receive the pin in the beam 28, or the like could also be utilized to secure the beam 28 or 30 within the channel 26.

Figure 8:
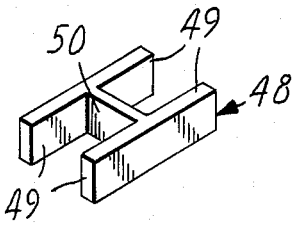
FIG. 8 is a perspective view of a spacer for separating the wheels shown in FIG. 3.
Figure 7:
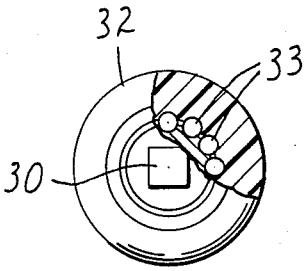
FIG. 7 is a side elevation view of a wheel shown on FIG. 3 with portions broken away to show structure therein.
Figure 2:
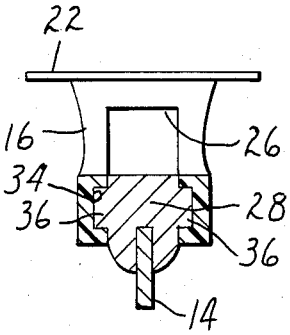
FIG. 2 is a partial sectional view taken along line 2—2 of FIG. 1.
Figure 3:
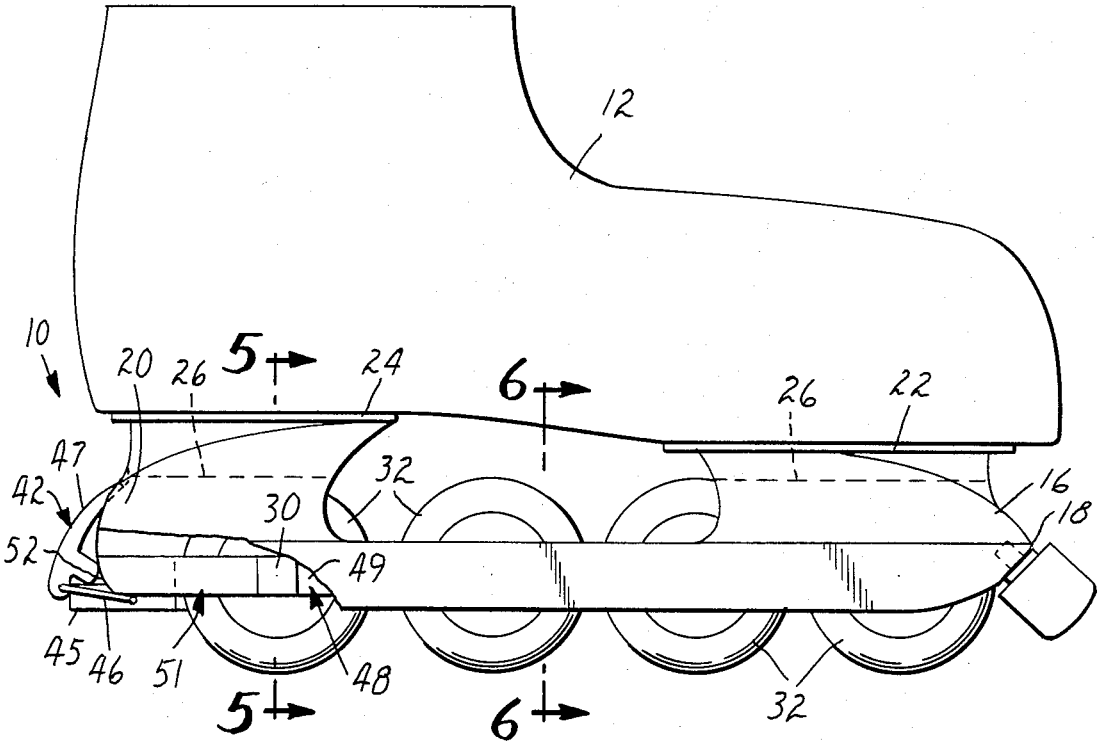
FIG. 3 is a side elevational view of a second embodiment of the present invention.
Figure 4:
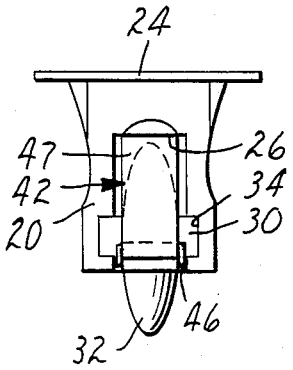
FIG. 4 is a partial rear view of the skate shown in FIG. 3, as seen from the left side.

The shoe of the skate 10 is designed to be used with wheels 32 as well as an ice blade 14. As illustrated in FIG. 3 the wheels 32 can be positioned at various points along the channel 26 in order to optimize the performance of the skate 10, for example, to match its performance to that of its ice skating counterpart. It is also possible to add or subtract wheels 32 depending upon whether the person using the skate 10 desired to maximize his speed or the smoothness of his ride. The wheels 32 have dimetrical dimensions that substantially exceed their width dimensions at their axes. In this embodiment, the elongate beam 30 located within the channel 26 provides the axis for the wheels 32 and thus supports an arrangement of bearings 33 around which the wheels 32 can rotate (See FIG. 7) with one part of the periphery of each wheel 32 closely adjacent the inner wall defining the channel 26, and the peripheries of the wheels 32 opposite that inner wall projecting through the opening for the channel 26. The individual wheels 32 are inserted within the channels as has already been described. The desired spacing between the wheels is achieved by inserting individual spacers 48 (See FIG. 8) which are cut to the correct size to space the wheels 32 at the desired positions. These spacers 48 are inserted between the wheels at the time the wheels 32 are inserted. The spacers 48 are made from an inexpensive extruded plastic, which is easily cut to the correct size in order to provide the desired positioning of the wheels 32. The spacers 48 include side members 49 which are adapted to be received within the recesses 34 of the channel 26, and a central member 50 which interconnect the two members 49 and provide rigidity for the spacer 48. The side members 49 occupy the channels 26 and prevent the further insertion of the elongate beam 30 of the wheel 32 within the channels 26.

Figure 9:
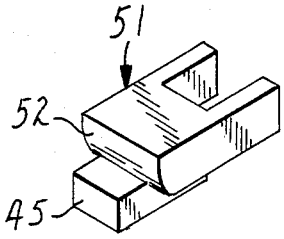
FIG. 9 is a perspective view of an end spacer as shown in FIG. 3.

After the last wheel 32 has been inserted within the channel 26 an end spacer 51 (See FIG. 9) is inserted. This end spacer 51 is similar to the spacer 48 except that includes a projecting ledge 45 which interacts with the camming mechanism 42 to secure the sheels 32 within the channel 26. The end spacer 51 also includes a curved end profile 52 which conforms to the end profile of the frame **1*b*, to provide an aesthetically acceptible termination of the spacer 51 within the channel 26. FIGS. 3 through 6 illustrate the relationship between the frame 16, the spacers 48 and 51, and the wheels 32 for various positions along the channel 26. It can therefore be seen that the present invention enables a skater to interchange ice blades 14 and wheel assemblies 32, keeping the same shoe or boot 12. This can even be done without removing the boot 12. The skater can also position the ice blade 14 or the various wheels 32** to achieve different performance characteristics with the same skate, thus further complementing the flexibility of the present invention.

Having thus described the present invention, it will be understood that changes may be made in the size, shape or configuration of some of the parts described herein without departing from the present invention as recited in the appended claims.

What is claimed is:

1. A skate comprising a boot including a sole having a bottom surface, an operative portion affording relative movement of the skate with respect to a supporting surface and including means for making contact with said support surface only along a single straight narrow area, and means for releasably fastening said operative portion to said boot, said means including:

a frame having top and bottom surfaces fixed to said sole with the top surface of said frame against the bottom surface of said sole, said frame having walls defining an elongate channel extending longitudinally of said boot and having an opening through the bottom surface of said frame, the walls defining said channel including opposed side walls extending to said opening, and an inner wall opposite said opening, the transverse cross sectional shape of said side walls having greater length than width in a direction normal to said bottom surface of said sole, the width of said frame along said side walls being substantially less than the width of said sole, said walls defining a transverse cross sectional shape for said channel that has a greater length than width in a direction normal to the bottom surface of the said sole, and said channel releasably receiving said operative portion with parts of said operative portion and said side walls being in close fitting relationship including projections on said operative portion, said projections having a greater height than width in a direction normal to the bottom surface of said sole and being received in recesses in said side walls and parts of said operative portion projecting along said side walls to a position closely adjacent said inner wall; and manually operable means for releasably securing said operative portion in said channel at a predetermined position with respect to said frame with said single straight narrow area centrally aligned with said opening.

2. A skate according to claim 1 wherein said walls of said frame define at least one open end for said channel affording the insertion or removal of said operative portion with respect to said channel.

3. A skate according to claim 1 wherein said operative portion comprises;

a plurality of wheels having axes, each of said wheels having a diametrical dimension that substantially exceeds the width dimension of said wheel at said axis; and beams rotatably supporting said wheels at said axes and being engaged with said sidewalls to support said wheels in said channel with the axes of said wheels within said channel, one part of the periphery of each of said wheels closely adjacent said inner wall, and the peripheries of said wheels opposite said inner wall projecting through the opening in said frame.

4. An assembly adapted to be attached to a sole of a boot to form a skate, said assembly comprising:

an operative portion affording relative movement of the skate with respect to a supporting surface and including means for making contact with said support surface only along a single straight narrow area;

a frame having top and bottom surfaces and having walls including a top wall comprising a plate-like portion defining a top surface and being adatped to be attached to a said boot with said top surface against the sole of the boot, and walls defining an elongate channel extending longitudinally of said boot and having an opening through the bottom surface of said frame, the walls defining said channel including opposed side walls extending to said opening, and an inner wall opposite said opening, the transverse cross sectional shape of said side walls having greater length than width in a direction normal to said top surface, the width of said frame along said side walls being substantially less than the width of said sole, said walls defining a transverse cross sectional shape for said channel that has a greater length than width in a direction normal to said top surface, and said channel releasably receiving said operative portion with parts of said operative portion and said side walls being in close fitting relationship including projections on said operative portion, said projections having a greater height than width in a direction normal to the bottom surface of said sole and being received in recesses in said side walls and parts of said operative portion projecting along said side walls to a position closely adjacent said inner wall; and manually releasable means for releasably securing said operative portion in said channel at a predetermined position with respect to said frame with said single straight narrow area centrally aligned with said opening.

5. An assembly according to claim 4 wherein said walls of said frame define at least one open end for said channel affording the insertion or removal of said operative portion with respect to said channel.

6. An assembly according to claim 4 wherein said operative portion comprises:

a plurality of wheels having axes, each of said wheels having a diametrical dimension that substantially exceeds the width dimension of said wheel at said axis; and beams rotatably supporting said wheels at said axes and being engaged with said sidewalls to support said wheels in said channel with the axes of said wheels within said channel, one part of the periphery of each of said wheels closely adjacent said inner wall, and the peripheries of said wheels opposite said inner wall projecting through the opening in said frame.

* * * * *